United States Patent [19]

Ross et al.

[11] Patent Number: 4,517,751

[45] Date of Patent: May 21, 1985

[54] AZEOTROPIC DRYING PROCESS

[75] Inventors: Steven L. Ross, Chagrin Falls; Otto H. Tachovsky, Solon, both of Ohio

[73] Assignee: General Signal Corporation, Stamford, Conn.

[21] Appl. No.: 505,409

[22] Filed: Jun. 17, 1983

[51] Int. Cl.[3] ..... F26B 3/04

[52] U.S. Cl. ..... 34/10; 34/27; 34/32; 34/37; 34/77

[58] Field of Search ..... 34/9, 17, 77, 76, 27, 34/32, 69, 10, 37

[56] References Cited

U.S. PATENT DOCUMENTS

| | | | |
|---|---|---|---|
| 2,256,017 | 9/1941 | Curran . | |
| 3,094,431 | 6/1963 | Goldstein et al. . | |
| 3,298,109 | 1/1967 | Bohrer | 34/9 |
| 3,518,773 | 7/1970 | Johanson . | |
| 3,541,696 | 11/1970 | Dunn, Jr. . | |
| 3,982,325 | 9/1976 | Sigl et al. | 34/9 |
| 3,998,588 | 12/1976 | Coraor et al. . | |
| 4,212,112 | 7/1980 | LaDelfa et al. . | |

*Primary Examiner*—Larry I. Schwartz

*Attorney, Agent, or Firm*—Barnes & Thornburg

[57] ABSTRACT

A process is disclosed for drying moisture-laden feedstock of a wide variety in a continuous process stream which involves passing the feedstock to a fluid bed dryer which receives organic solvent vapors capable of forming an azeotrope with the water of the feedstock stream, passing thereafter into a residence dryer provided with the heat from superheated organic solvent vapors which are passed together with the feedstock stream into a cyclone separator, from which a dried and solvent free feedstock stream is recovered. The solvent vapors are returned to the fluid bed dryer, and means are provided for recovering the solvent from the formed azeotrope and returning the same to the system. Exemplary feedstocks and solvents are disclosed.

9 Claims, 1 Drawing Figure

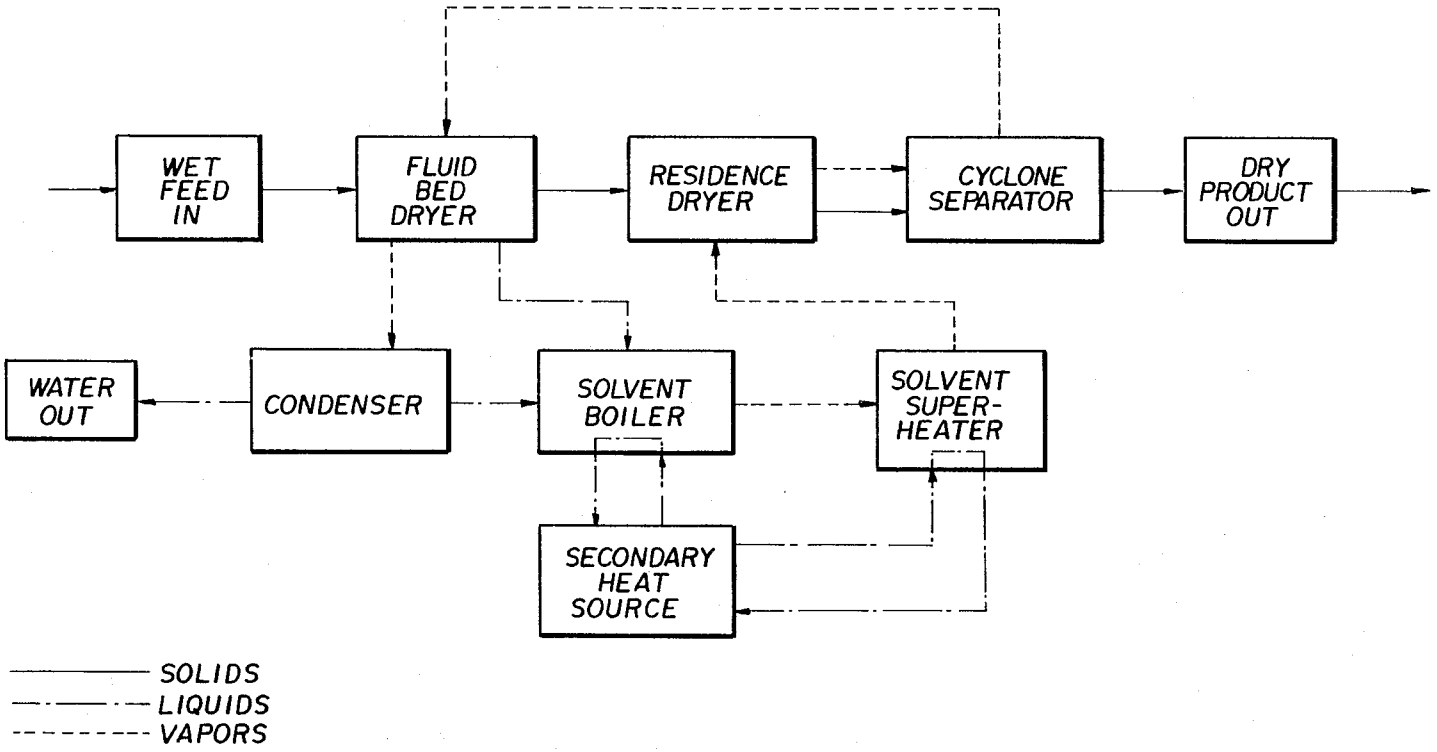
WET FEED IN
FLUID BED DRYER
RESIDENCE DRYER
CYCLONE SEPARATOR
DRY PRODUCT OUT
CONDENSER
SOLVENT BOILER
SOLVENT SUPER-HEATER
SECONDARY HEAT SOURCE
WATER OUT
SOLIDS
LIQUIDS
VAPORS

AZEOTROPIC DRYING PROCESS

BACKGROUND OF THE INVENTION

This invention relates to a process and system for drying moisture-laden feedstock materials through the use of solvent vapors which form an azeotrope with water. More specifically, this invention relates to a process which can dry a continuous stream of moisture-laden feedstock.

One fundamental process common to a wide range of industries is the drying of a feedstock to be subjected to further processing or uses. The feedstock can be of the type to be burned or processed to release energy such as carbonaceous products and municipal refuge, feedstocks which require drying for reactivation or other further processing, such as ion exchange resins, and feedstocks which will be subjected to further processing so as to be incorporated in a compound or processed product, such as wet pulp materials. Characteristically, drying these feedstocks by simple application of heat is so expensive and time consuming as to be practically and economically impossible.

Accordingly, various industries have adopted a number of solutions to the problem. One solution practiced widely in the carbonaceous products industries is the combination of a combustion feedstock, e.g., coal, with a solvent which, upon the application of heat, will form an azeotrope with the moisture in the feedstock, which can be flashed or evaporated off at substantially lower temperatures than simple heat-applied drying would require. U.S. Pat. No. 4,212,112 is an example of just such a process, which employs benzene as the solvent. However, this patent, which is characteristic of the art in general, a process which requires first mixing the feedstock, coal, and the organic solvent, benzene, in a liquid state to form a slurry, and thereafter applying heat to the formed slurry, subsequently separating off the vapor and the feedstock and recycling. This process is however, disadvantageous in a number of respects.

First, the process requires the separate steps of the formation of a slurry prior to the evaporation of the azeotrope and further processing, requiring two independent steps. it would be far more economical, and advantageous, to employ a process which operated on a continuous feedstock stream, as this would require less handling, less machinery, and be capable of far greater processing capability.

Second, the process of U.S. Pat. No. 4,212,112, as well as a related process for drying wood, described in U.S. Pat. No. 3,094,431 are feedstock-specific, that is, they are applicable to drying of only one type of feedstock, for a single end purpose.

Third, most of the processes, including the processes of the above-referenced patents, require downstream processing to separate the feedstock from the solvent remaining therewith, in a dried slurry. This further increases the cost, and limits the processing capacity, of the system.

Accordingly, it is one object of this invention to provide a drying process which overcomes the above-described disadvantages.

It is another object of this invention to provide a drying process which dries a continuous stream of feedstock, without separated mixing steps.

It is a further object of this invention to provide a drying process which is not feedstock-specific, and can be applied to a wide range of moisture-laden feedstock types.

It is yet another object of this invention to provide a process which delivers the dried feedstock in an essentially solvent-free condition, not requiring further processing for the removal of the solvent.

SUMMARY OF THE INVENTION

This invention involves the transporation of a continuous process stream of moisture-laden feedstock through various stages, the feedstock exiting the system dry and free of solvent. The feedstock is introduced to a fluid bed dryer, into which is introduced vapors of an azeotrope-forming solvent which are produced in a solvent boiler and superheater. The wet feedstock next passes to a residence dryer, which drives off any remaining moisture and vaporizes liquid solvent by the vapors of the solvent which pass directly from the superheater into the residence dryer. Solvents and azeotrope vapors are separated from the feedstock stream in a cyclone separator. The process stream leaves the system dry and free of solvent, and means are provided for recovering the solvent and separating out the water from the formed azeotrope.

BRIEF DESCRIPTION OF THE DRAWINGS

The FIGURE attached herewith is a process flow chart for the invention claimed herein, illustrating the separate steps and pathways of solids, liquids and vapors.

DETAILED DESCRIPTIONS OF THE INVENTION

As noted above, the system of this invention is suitable for drying any of a wide range of moisture-laden feedstocks, this system relying not so much on the characteristics of the feedstock but rather on the ability of certain organic solvents to form azeotropes with the water of the feedstocks. Typical feedstocks which can be dried in this process include natural, carbonaceous products such as coal, lignite, peat, wood, etc.; municipal refuse prior to its incineration; porous, water-filled polymer beads such as ion exchange resins, wet paper or wood pulp, and in general, finely ground, wet solids.

The feedstock is first introduced to a fluid bed dryer, which is fed vapors of a water-azeotrope forming solvent. The speed of the feedstock stream is set so as to allow sufficient time in the fluid bed dryer for the formation of the azeotropic vapor mixture of the solvent and moisture in the process stream. Although, as a general rule, the residence time in the fluid bed dryer will vary from approximately 15–75 minutes, the selection of an appropriate residence time will be within the talent of those of skill in the art, based on the choice of drying solvent(s) and the materials being processed. It should be noted that the fluid bed dryer, as well as the other equipment employed in the instant process, is conventional equipment.

From the fluid bed dryer, as disclosed in the FIGURE, the continuous process stream is passed to a residence dryer, which receives superheated solvent vapors which are passed eventually to the fluid bed dryer. The vapors pass into the residence dryer at a temperature which maintains the temperature of the atmosphere in the residence dryer at a range of 250–400 F., depending on the solvent choice. The time the process stream spends in the residence dryer as it moves through the system is also dependent on the materials and solvents employed. However, residence time is not critical in this particular step, as most of the original feedstock moisture has been vaporized as the azeotrope, and the residence dryer is principally employed to remove any residual solvent adhering to the feedstock, and allow the formation of azeotropic combinations between any remaining water in the process stream and the solvent vapors in the residence dryer. By employing the residence dryer, subsequent drying steps of the feedstock, to remove solvent, etc. are rendered unnecessary.

From the residence dryer, the process stream, together with the vapors comprising both the azeotropic combination of solvent and water and solvent vapors are passed to a separator, preferably a cyclone separater. Therein, all the vapors are removed and passed to the fluid bed dryer as discussed above. The dried and solvent free feedstock process stream is taken from the separator in a condition appropriate for further processing, or combustion, as the case may be.

As noted, the feedstocks are introduced, in a continuous process stream, into a fluid bed dryer, the atmosphere of which is provided with vapors of suitable organic solvents, which vapors are received from a cyclone separator and residence dryer. The solvents that can be used in this process generally include aliphatic hydrocarbons, aromatic hydrocarbons, halogenated hydrocarbons, ketones, aldehydes, esters and alcohols. In general, the solvent choice will be dictated by the nature of the feedstock employed, and by considerations of vapor pressure, relative safety, cost and availability. The selection of the particular solvent for a particular feedstock in a particular process can be easily done by those of ordinary skill in the art. As a general rule the boiling points of these solvents range between 150–300 F. Without limitation, certain exemplary solvents include styrene, toluene, m-xylene, and benzene.

As solvent vapors pass through the residence dryer, separator and into the fluid bed dryer, heat is continuously lost. Therefore, the solvents are first boiled in a solvent boiler which is heated by a secondary heat source, such as a dedicated boiler or more preferably waste heat from the plant. To ensure the vapors are hot enough to flash off any solvent or water adhereing to the feedstock, and to remain in the vapor state while passing to the fluid bed dryer, they are passed from the boiler to a superheater, which raises the temperature to the aforementioned 250–400 F. range. This is sufficient to ensure the solvent vapors reach the fluid bed dryer in vapor phase, albeit the temperature across the fluid bed dryer may drop, to an average of about 150–200 F., or more for extremely high boiling point solvents.

The azeotropic vapors found in the fluid bed dryer are passed to a condenser, as illustrated in the FIGURE. Therein, the azeotropic vapors are cooled, and the water separated from the organic solvent, now both in a liquid state. The water may be taken off for any of a variety of uses. The solvent separated out in the condenser is passed to the solvent boiler, and thereafter the solvent superheater, to reenter the residence dryer and repeat the process, thereby providing for conservation of the solvent, and improving cost efficiency.

Liquids, consisting essentially of cooled solvent vapors, are present in the fluid bed dryer. These liquids are passed directly to the solvent boiler, and thereafter as described above. As the azeotrope of water and solvent remains a vapor at temperatures lower than the solvent alone, appreciably no water is passed to the solvent boiler through this process.

This invention has been disclosed, above, as a process suitable for the drying of any of a wide range feedstocks in a continuous process stream, which results in a dried and solvent free feedstock through an economical system. This system is solvent conservative, and relies upon the azeotropic-forming capabilities of the selected solvent, as well as the temperature of solvent vapors, for the drying process. The process is further attractive in that it does not require any new or unconventional equipment or machinery for its effective operation.

The above process has been described with regard to the specific examples, particularly as to selected feedstocks, solvents and equipment. However, these are recited for illustrative purposes, and are not intended to be restrictive. Common variations will occur to those of ordinary skill in the art without the exercise of inventive faculty and will remain within the scope of the invention as claimed below.

What is claimed is:

1. A process for drying a continuous stream of moisture-laden feedstock, comprising the steps of:

introducing said feedstock stream into a fluid bed dryer in which is maintained an atmosphere of water-azeotrope forming solvent vapors and maintaining said feedstock in said fluid bed dryer for a time sufficient to allow the formation of azeotropes between the moisture of said feedstock and said solvent vapors;

passing said feedstock through a residence dryer which is provided with superheated vapors of said solvent, thereby removing any residual solvent and moisture from said feedstock stream;

passing said feedstock stream and vapors from said residence dryer to a separator wherein said feedstock stream is separated off from said vapors; and recovering from said separator an essentially dried and solvent free feedstock stream.

2. The process of claim 1, wherein the vapors separated off in said separator are fed to said fluid bed dryer.

3. The process of claim 1, wherein said feedstock is selected from the group consisting of coal, lignite, peat, wood, municipal refuse prior to incineration, ion exchange resin, wet wood pulp, wet paper pulp, and finely ground, wet solids.

4. The process of claim 1, wherein said solvent has a boiling point range of about 150–300 F.

5. The process of claim 1, wherein said solvent is selected from the group comprising aliphatic hydrocarbons, aromatic hydrocarbons, halogenated hydrocarbons, ketones, aldehydes, esters, alcohols and mixtures thereof.

6. The process of claim 1, wherein said solvent is selected from the group consisting of styrene, toluene, m-xylene, benzene, and mixtures thereof.

7. The process of claim 1, wherein the time spent by said feedstock stream in said fluid bed dryer is from about 15–75 minutes, the temperature range in said fluid bed dryer is about 150–300 F. and the temperature range in said residence dryer is from about 250–400 F.

8. The process of claim 1, wherein said separator is a cyclone separator.

9. The process of claim 2, wherein said formed azeotropes are fed to a condenser, wherein they are liquified into two phases, the water phase being separted off and the organic solvent phase being returned to a solvent boiler, which vaporizes said solvent, said vapors thereafter being passed to a superheater and from there to said residence dryer.

* * * * *